United States Patent [19]

Gordon et al.

[11] 3,933,595

[45] Jan. 20, 1976

[54] OVEN DOOR FUME COLLECTION SYSTEM

[75] Inventors: Gerome Gordon, Harding Township, Morris County; Paul V. Faber, Morristown, both of N.J.

[73] Assignee: Wilputte Corporation, Murray Hill, N.J.

[22] Filed: June 21, 1974

[21] Appl. No.: 481,665

[52] U.S. Cl. ..... 201/2; 98/115 R; 110/179; 202/263; 432/64

[51] Int. Cl.² ..... C10B 27/00; C10B 25/02

[58] Field of Search ..... 201/2; 202/262, 263, 227, 202/248; 110/179, 173 R; 98/36, 115 R; 432/79, 249, 64, 65; 266/15, 16

[56] References Cited

UNITED STATES PATENTS

| | | | |
|---|---|---|---|
| 1,245,030 | 10/1917 | Rockwell | 432/64 |
| 1,873,076 | 8/1932 | VanAckeren | 110/173 R |
| 1,911,394 | 5/1933 | Ritter | 110/179 |
| 2,424,865 | 7/1947 | Tweit | 202/263 X |
| 2,954,968 | 10/1960 | Vedder | 432/64 |
| 3,386,365 | 6/1968 | Jensen | 98/36 |
| 3,708,414 | 1/1973 | Laube | 98/36 X |
| 3,809,622 | 5/1974 | Knappstein et al. | 202/263 |
| 3,834,293 | 9/1974 | Danieli | 266/15 X |
| 3,834,995 | 9/1974 | VanAckeren | 202/248 |
| R13,713 | 4/1914 | Rockwell | 432/64 |

*Primary Examiner*—Joseph Scovronek
*Assistant Examiner*—Arnold Turk
*Attorney, Agent, or Firm*—Buell, Blenko & Ziesenheim

[57] ABSTRACT

Apparatus adapted to reduce emissions from the doors of coke ovens and the like includes a separate fume collecting hood positioned above each oven door, manifolds connected therewith and with a suction fan and gas cleaner, a valve in each hood, a series of nozzles for an aspirating fluid spaced along each oven door jamb, supply pipes therefore and a supply main, valves in the supply pipes, a closed coke guide adapted to be positioned against an oven being pushed, and spring-urged means carried by the end of the coke guide adapted to seal the guide to the oven.

8 Claims, 4 Drawing Figures

OVEN DOOR FUME COLLECTION SYSTEM

This invention relates to fume collection or pollution abatement systems for industrial ovens. It is more particularly concerned with apparatus for drawing off the fumes and gases which escape around coke oven doors and which are released from the doorway when the door of a coke oven is removed.

While our invention is especially well suited for coke oven use it is also adapted to other types of ovens the doors of which must be removed from time to time. For convenience it will be described hereinafter in connection with conventional by-product coke oven batteries. Those batteries comprise a large number of narrow ovens placed side-by-side, the walls between the ovens being provided with heating flues. The ovens are charged with coal through holes in their roofs and are closed at each end with doors.

After coking is completed it is necessary to remove both doors of an oven to eject coke therefrom. The doors are removed by apparatus mounted on cars which travel on rails along the battery, one on each side. The ejection is accomplished with a pusher ram which is mounted on a car moving on rails along one side only of the battery, known as the "pusher" side. The car is spotted at the appropriate oven and the ram is caused to move through the oven, pushing out the coke ahead of it through the other door on the coke side of the battery. The hot coke must be quenched with water, which is accomplished by passing it through a coke guide into a car and either carrying it to a fixed quenching station or quenching it as it leaves the oven in a quenching car.

Prior to our invention to be described, gases and entrained solids from the hot coke escaped through the open pusher side doorway of the oven into the atmosphere, thus contributing to air pollution in the vicinity of the coke oven battery. Historically, the same thing occurred on the coke side of the battery. Attempts have recently been made to reduce emissions from the coke side of the battery. Apparatus for that purpose is disclosed in U.S. Pat. No. 3,647,636 captioned "System For Collecting Dust and Smoke When Coke is Pushed From a Coke Oven," issued to E.J. Helm, on Mar. 7, 1972. That apparatus exhausts gases from the coke side of an oven by suction fans carried by the coke guide. It does not, however, collect gases that leak out between oven and coke guide, nor is it applicable to the pusher side of the battery.

It is an object of our invention to provide apparatus which draws off gases which escape around coke oven doors and which are emitted from an oven when its doors are removed. It is another object to provide apparatus which aspirates those gases into a recovery system. It is another object to provide sealing means between a coke oven door opening and a coke guide. Other objects of our invention will appear in the course of the description thereof which follows.

We accomplish the above objects by providing the coke oven battery with a fume collecting hood above each oven door, a fume collecting main which extends the length of the battery on each side above those hoods, a gas cleaner connected with the fume collecting main by a suction fan, a separate duct provided with a valve connecting each hood with the fume collecting main, an upright steam or compressed air pipe positioned on each side of each coke oven doorway, a plurality of nozzles affixed to each pipe spaced from each other and directed upwardly and toward the edge of the door, a steam or compressed air supply pipe, and a separate valve connection between that supply pipe and the pipes adjacent each oven door.

The above mentioned apparatus is suitable both for the pusher side and for the coke side of the battery and preferably is installed on both sides. We also provide on the coke side of the ovens an open-ended but otherwise closed coke guide which is movable toward and away from the oven door opening and, at the coke oven end of the guide, spring-loaded sealing means which greatly reduce gas leakage from the oven at that point. We prefer to use with the above a commercially available mobile continuous coke quencher which continuously quenches the coke delivered to it through the coke guide and cleans the gases evolved therefrom.

An embodiment of our invention presently preferred by us is illustrated in the attached figures, to which reference is now made.

Figure 1:
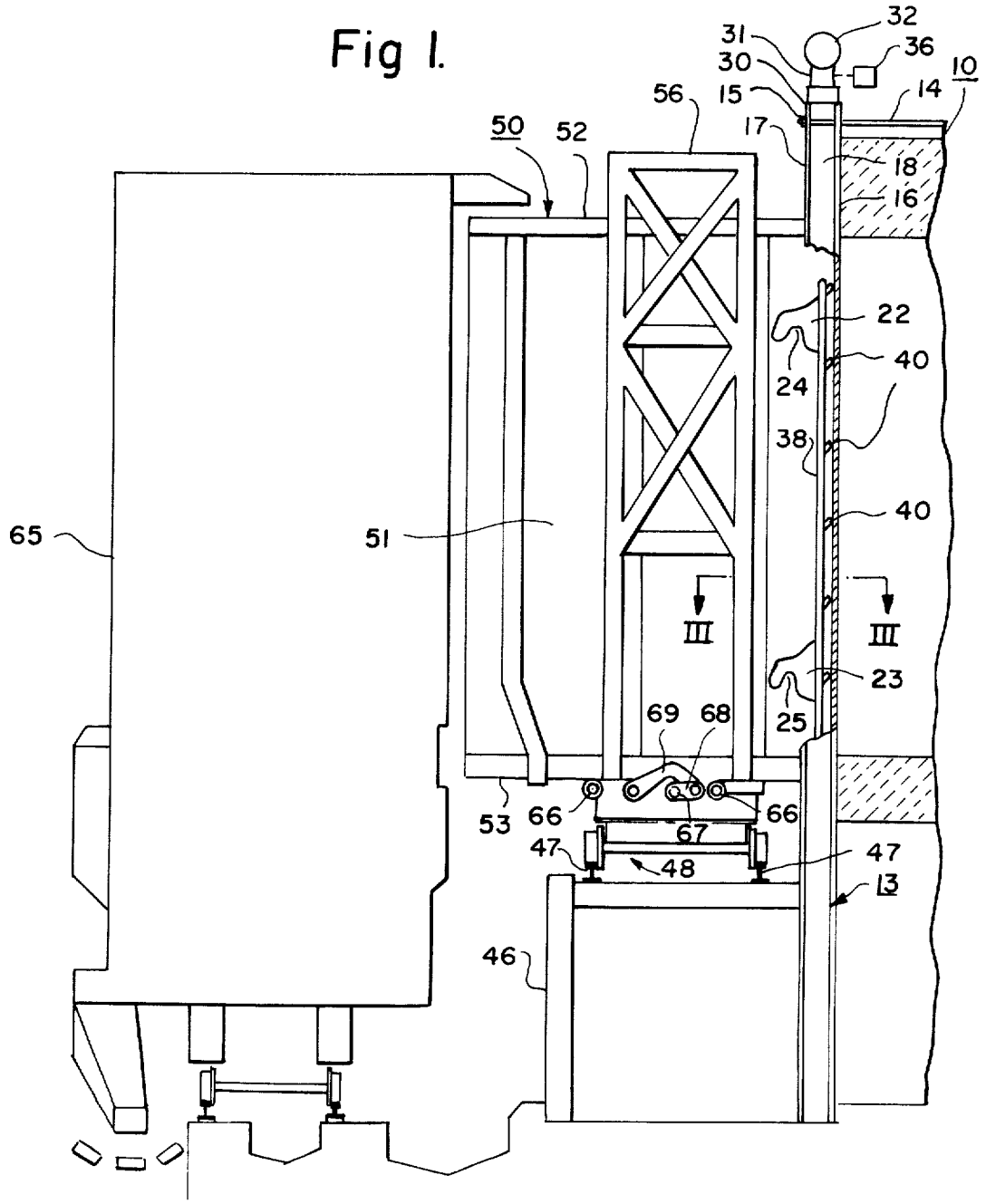
FIG. 1 is an end evaluation partly broken away of a coke oven battery, a coke guide and, in outline only, a mobile continuous coke quencher.

Coke oven battery 10 comprises a plurality of individual ovens, such as ovens 11 and 12. Along each side of battery 10 between each pair of ovens is a vertical buckstay 13, the upper end of which projects above the battery 10 and is connected across the battery to a like buckstay on the opposite side by tie rods 14. Those tie rods are pulled up by nuts 15. Buckstays 13 are wide flange beams, as is apparent from FIG. 3, each comprising an oven face flange 16, an outer flange 17, and a web 18. From the end face of each oven projects on one side, the left side in FIG. 2, upper hook bar 20 and lower hook bar 21, and on the right side, corresponding upper hook bar 22 and lower hook 23. Hook bars 22 and 23 terminate in downwardly opening hooks 24 and 25, respectively, as may be seen in FIG. 1. Hook bars 20 and 21 terminate in upwardly opening hooks of the same type, not shown in profile. The door of the oven latches in those hook bars.

Above the door opening of each coke oven, such as oven 11, is positioned a fume hood 30 which is rectangular in plant. Its width is adjusted so that it fits between the upper ends of the buckstays 13 on each side of oven 11 and its depth is substantially the depth of web 18 of the buckstays. The top of hood 30 opens into vertical duct 31 which communicates with manifold 32 which extends along the side of coke oven battery 10 above hoods 30. This manifold is connected at one end to a suction fan 33 which exhausts into gas washer 34. The cleaned gases from that washer are exhausted into the air. Vertical duct 31 is provided with a valve 35 and operating means 36 therefor. Those means may be mechanical, pneumatic or electrical.

Figure 2:
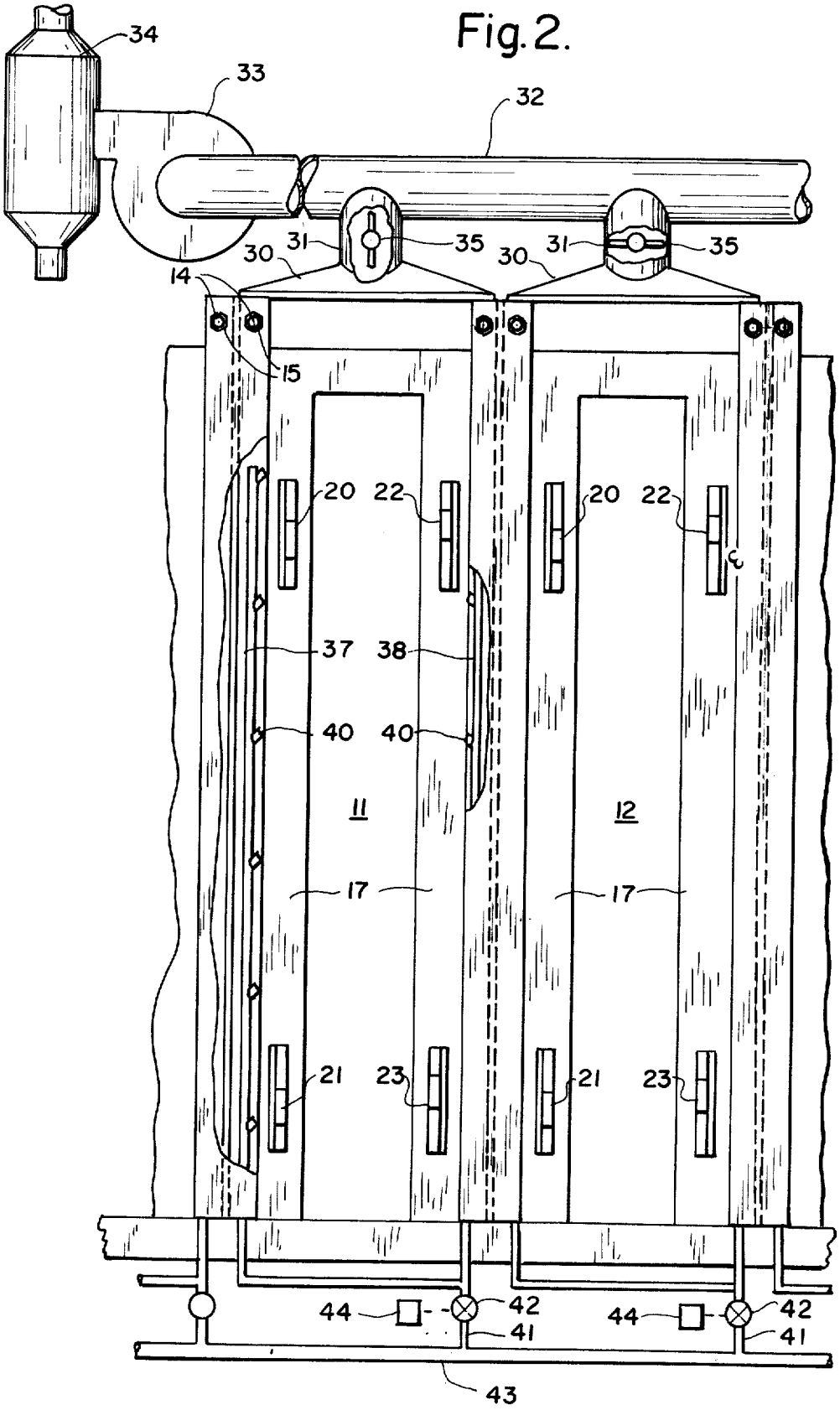
FIG. 2 is a side elevation partly broken away of a portion of a coke oven battery with the oven doors removed.
Figure 4:
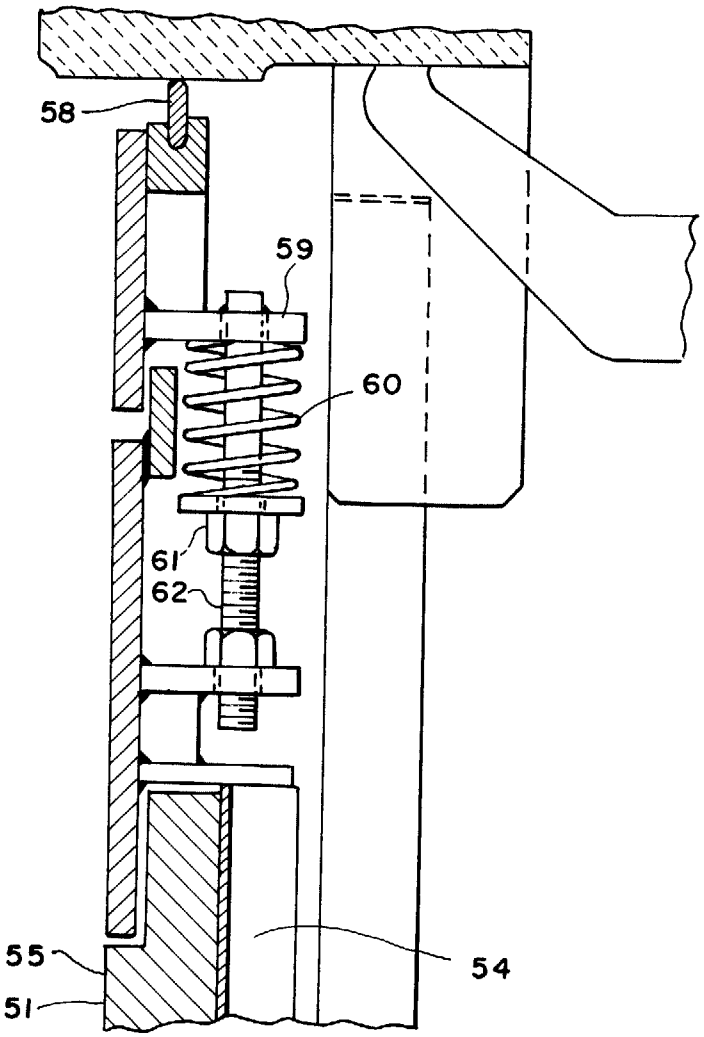
FIG. 4 is a detail to an enlarged scale of a portion of the apparatus shown in FIG. 3.
Figure 3:
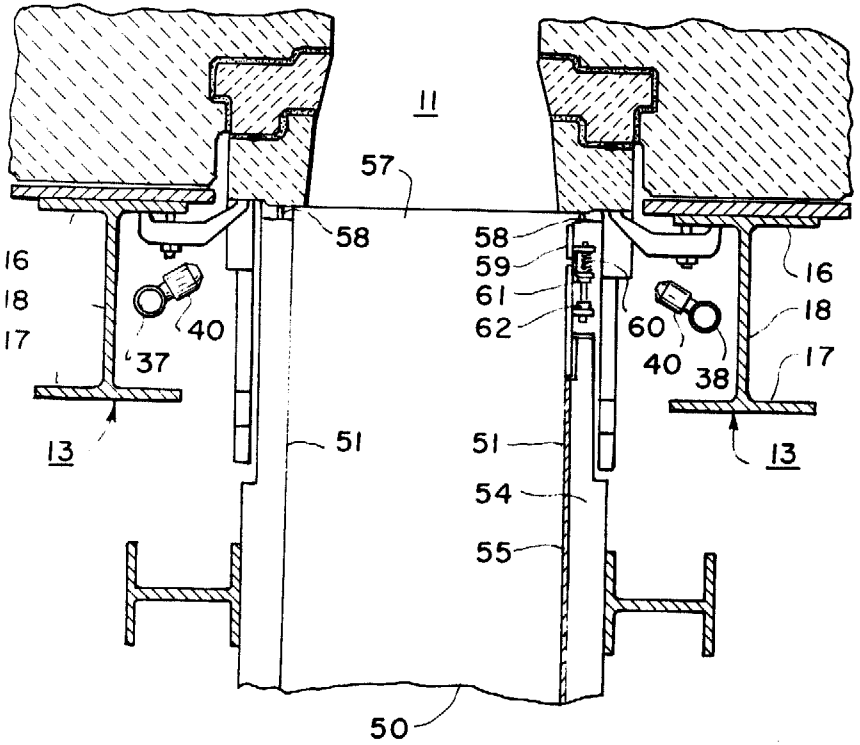
FIG. 3 is a cross-section of a portion of the apparatus of FIG. 1 taken on the plane III-III.

A vertical fluid conductor or pipe 37 is positioned along one side of the door jamb of oven 11 and a similar vertical pipe 38 is positioned along the other side of that door. As shown in FIGS. 2 and 3, pipe 37 is on the left side of the oven 11 and pipe 38 on the right side. Pipes 37 and 38 are provided with spaced nozzles 40 along their length, each nozzle 40 being inclined upwardly and inwardly toward the door opening of the oven. Pipes 37 and 38 and their attached nozzles are positioned adjoining web 18 and between flanges 16 and 17 of the buckstay 13 on each side of the oven door opening. At their lower ends below the oven door opening pipes 37 and 38 are connected with a single pipe 41 provided with a valve 42. The other end pipe 41 connects with a fluid supply main 43 which runs along the side of the battery. Valve 42 is mechanically connected to operating means 44, which may be similar to operating means 36 previously mentioned.

Along the coke side of battery 10 runs a bench 46 supporting rails 47. A wheeled car 48 movable along rails 47 carries coke guide 50. This guide is an open-ended but otherwise closed shell comprising parallel upstanding side walls 51, a top 52 and a flat bottom 53. The spacing between side walls 51 is slightly greater than the width of an oven and the spacing between top 52 and bottom 53 is likewise approximately the height of an oven. Coke guide 50 is lined with refractory material 54, the inside of which is protected by a skin 55 is ductile iron sheet. The structure is supported on car 48 within an upright frame 56. Coke guide 50 is mounted for movement on rollers 66 of car 48 toward and away from oven 11 as will be described.

A shaft 67 is journaled on car 48 parallel to rails 47. A crank arm 68 is affixed at one end to the shaft. The other end of crank arm 68 is pivotally connected to one end of bent lever arm 69, and the other end of that arm is pivotally connected to the bottom 53 of coke guide 50. Shaft 67 is rotated by means not shown which may be mounted on car 48 or on another car coupled to car 48.

In the working position of coke guide 50 its entry end 57 abuts the door opening of oven 11 between upper hook bars 20 and 22 and lower hook bars 21 and 23. The clearance here is close. A narrow sealing edge 58 projects beyond entry end 57 of the guide all around that end. It is held in that projecting position by a plurality of spaced brackets 59, each urged toward the oven by a compression coil spring 60 butted against a nut 61 adjustably positioned on threaded rod 62 which is affixed to entry end 57 of coke guide 50 aligned with the long axis of that guide. Bracket 59, spring 60, nut 61 and rod 62 do not extend beyond the thickness of side wall 51 of coke guide 50 on either side. Sealing edge 58 is quite similar to the sealing edge which is part of the well-known Wilputte coke oven door. That door is illustrated on page 122 of the 8th Edition by U.S. Steel Corporation.

The discharge end of coke guide 50 discharges coke into a mobile quencher 65 which is a commercially available apparatus and will therefore not be described here. A suitable quencher is disclosed in U.S. Pat. No. 3,536,592 issued to J.A. Scharbrough et al on Oct. 27, 1970.

The operation of our apparatus will be described with reference to the figures and the foregoing description. The apparatus illustrated in FIG. 2 is adapted for use on both the pusher side and coke side of the battery; the additional apparatus illustrated in FIGS. 1 and 3 is used only on the coke side of the battery. The operation of our apparatus as used on the pusher side of the ovens will first be described.

Valve 35 is normally slightly open as it is shown above oven 12 in FIG. 2. Blower 33 then tends to suck gases escaping around the oven door through hood 30 into manifold 32, thus preventing their escape to the atmosphere. When an oven, 11 for example, is to be pushed, however, its doors are removed in the usual way and at this time valve 35 is turned to the full open position shown above oven 11 in FIG. 2. At the same time valve 35 is opened, valve 42 below oven 11 is also opened, connecting pipes 37 and 38 with fluid supply main 43. Steam, air or other gaseous fluid is supplied through that main to pipes 37 and 38 and is sprayed out of nozzles 40 as jets directed upwardly and toward the door opening of oven 11. Those jets of fluid entrain gases from the oven, and are sucked up into hood 30. In this way the gases and solids emitted from the oven are collected and disposed of.

When the coke has been pushed from the oven and its doors replaced, valve 35 is turned to its slightly open position and valve 42 is closed. As only one oven of the battery is pushed at a time and as it is seldom that more than two ovens have their doors removed at the same time, manifold 32 need not be large, nor need suction fan 33 be of large capacity. It is convenient to interlock valve operator 36 with valve operator 44 so that the suction and spray valves open and close together, and the valve operators may also be interlocked with the oven door removing apparatus to automate the entire operation.

On the coke side of the ovens the coke guide 50 is moved into place after an oven door has been removed. This is accomplished by propelling car 58 along rails 47 by means not shown to spot guide 50 in front of the open oven, for example, oven 11. During this movement, coke guide 50 is in its traveling position, that is to say, shifted laterally of car 48 away from the coke oven so that its entry end 57 clears buckstays 13. As has been indicated this movement is accomplished by rotation of shaft 67. When this shaft is rotated counterclockwise as seen in FIG. 1, crank arm 68 is also rotated in the same direction and pushed lever arm 69 to the left which, in turn, moves coke guide 50 away from the coke oven over rollers 66.

After car 48 has been spotted, shaft 67 is rotated clockwise, reversing the movements above mentioned and shifting coke guide 50 to the right in FIG. 1 against the door face of the oven. The mobile continuous coke quencher 65 is then moved into position to receive coke discharged through coke guide 50. The shifting of coke guide 50 toward the ovens cause the sealing edge 58 to make contact with the door face of oven 11 and forces edge 58 back somewhat against the urging of the spaced compression springs 60. A pressure seal between oven and coke guide is thus made. Against a new oven face a good seal is made by adjustment of nuts 61 on the various rods 62 but as the oven wears the seal deteriorates somewhat and, of course, the ovens do not wear uniformly. The force which can be exerted on sealing edge 58 is limited to a value less than that which would push car 48 off rails 47. Gases and entrained solids leaking out between coke guide 50 and oven 11, however, are aspirated and collected by the fluid injector nozzle and fume hood apparatus previously described. The mobile continuous quenching apparatus 65 is necessarily provided with means for collecting and disposing of the steam and gases produced by the quenching of the coke, and those means exhaust gases from the discharge end of the coke guide.

In the foregoing specification we have described a presently preferred embodiment of this invention, however, it will be understood that this invention can be otherwise embodied within the scope of the following claims.

We claim:

1. In a battery of coke ovens provided with a plurality of upright outwardly extending buckstays positioned along a side thereof and a plurality of vertically elongated door openings positioned between the buckstays the improvement comprising a pair of upright fluid conductors one positioned along each side of a door opening outside thereof between the door opening and its adjoining buckstay and within the outward extent of the buckstay, a fluid supply main connected therewith, a plurality of fluid nozzles spaced from each other along each fluid conductor and directed inwardly toward the door opening and upwardly, a fume hood positioned above the door opening, and suction-producing means connected therewith.

2. The apparatus of claim 1 in which the fume hood is positioned between the upper ends of the buckstays and within their outward extent.

3. Apparatus of claim 1 including an elongated open ended but otherwise enclosed coke guide having parallel side walls, means for moving the coke guide longitudinally toward and away from the door opening and sealing means affixed to the entry end of the coke guide adapted to seal the guide to the coke oven door opening when the coke oven guide is moved there against, those sealing means comprising a narrow sealing element extending around and beyond the entry end of the coke guide in line with the walls thereof, affixed thereto by compression spring means, those sealing means and spring means being contained within the coke oven guide wall limits.

4. The apparatus of claim 1 including an exhaust manifold connecting the suction-producing means with the fume hoods, a valve in each such fume hood connection and a valve in each connection between the fluid supply means and the pair of upright fluid conduits for each oven door.

5. The apparatus of claim 4, in which the exhaust manifold is positioned above the upper ends of the buckstays.

6. The method of collecting gases and solid particles escaping from the upright doorway of a coke oven comprising projecting jets of entraining fluid from each side of the doorway outside thereof inwardly toward the doorway and upwardly so as to entrain gases and solid particles therein and propel them upwardly against the doorway and applying upwardly directed suction immediately above the doorway so as to draw entraining fluid, gases and solid particles upwardly across the doorway into collecting means.

7. The method of claim 6 for collecting gases and solid particles escaping from the doorway of a coke oven while coke is being pushed therefrom including the steps of causing the coke from the oven to travel through a closed guide and urging the entry end of the guide against the oven doorway so as to seal it thereto.

8. The method of claim 6 in which the oven doorway has upright outwardly extending buckstays positioned on each side thereof and in which the jets of entraining fluid are projected within the buckstays and the suction is applied between the buckstays.

* * * * *